US010240406B2

(12) United States Patent
Livescu et al.

(10) Patent No.: US 10,240,406 B2
(45) Date of Patent: Mar. 26, 2019

(54) DUAL-WALLED RUNNING STRING FOR ELECTRIC DEVICES WITH POWER TRANSMISSION THROUGH RUNNING STRING

(71) Applicant: BAKER HUGHES, A GE COMPANY, LLC, Houston, TX (US)

(72) Inventors: Silviu Livescu, Calgary (CA); Thomas J. Watkins, Calgary (CA); Richard Snow, Chicago, IL (US); Geoffrey Presley, Spokane, WA (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 130 days.

(21) Appl. No.: 15/169,167

(22) Filed: May 31, 2016

(65) Prior Publication Data

US 2017/0342782 A1 Nov. 30, 2017

(51) Int. Cl.

| | |
|---|---|
| ***E21B 17/00*** | (2006.01) |
| ***E21B 17/20*** | (2006.01) |
| ***E21B 36/04*** | (2006.01) |
| ***E21B 43/12*** | (2006.01) |

(52) U.S. Cl.
CPC ..... *E21B 17/206* (2013.01); *E21B 36/04* (2013.01); *E21B 43/128* (2013.01)

(58) Field of Classification Search
CPC ..... E21B 17/206; E21B 17/003
See application file for complete search history.

(56) References Cited

U.S. PATENT DOCUMENTS

| | | | | |
|---|---|---|---|---|
| 2,795,397 | A * | 6/1957 | Hull | E21B 17/003 174/21 R |
| 5,207,273 | A * | 5/1993 | Cates | E21B 17/003 166/106 |
| 2012/0006444 | A1* | 1/2012 | Tupper | E21B 17/20 138/149 |
| 2012/0325459 | A1* | 12/2012 | Bridges | E21B 36/04 166/248 |
| 2017/0037685 | A1* | 2/2017 | Strachan | E21B 7/067 |
| 2017/0268320 | A1* | 9/2017 | Angman | E21B 43/26 |
| 2017/0330647 | A1* | 11/2017 | Xiao | H01L 37/046 |

* cited by examiner

*Primary Examiner* — D. Andrews
*Assistant Examiner* — Dany E Akakpo
(74) *Attorney, Agent, or Firm* — Shawn Hunter

(57) ABSTRACT

Arrangements for transmitting electrical operating power to a downhole electrically operated tool via a dual-walled conductive running string.

17 Claims, 5 Drawing Sheets

DUAL-WALLED RUNNING STRING FOR ELECTRIC DEVICES WITH POWER TRANSMISSION THROUGH RUNNING STRING

BACKGROUND OF THE INVENTION

1. Field of the Invention

The invention relates generally to the design of running strings and power arrangements for downhole electrically operated tools, such as electric submersible pumps.

2. Description of the Related Art

A large number of downhole electrically operated devices are used during drilling of a wellbore and subsequent production of hydrocarbons. These electrically operated devices include electric submersible pumps (ESPs) as well as a variety of electric sensors, electric heaters and electric motors.

Running strings are used to disposed downhole electrically operated devices into a wellbore. Presently, running strings can either be made up of interconnected sections of conventional oil field tubular members or be coiled tubing. Coiled tubing running strings have become a popular form of running string to run an ESP or other electrically operated devices into a wellbore. In part, this is because they permit an ESP to be installed and retrieved in a live well and obviate the need for a workover rig. The ESP is supplied operating power from surface via a power cable. In conventional systems, the power cable is either retained within the flowbore of the running string or clamped to the outer radial surface of the running string. Even where the power cable is armored, it presents a potential failure point for an ESP arrangement due to wellbore debris and corrosion.

SUMMARY OF THE INVENTION

In accordance with the present invention, a dual-walled running string is used to dispose an electrically-operated device, such as an ESP into a wellbore and to provide operating power to the ESP. The dual-walled running string is preferably formed of coiled tubing but might also be formed of dual strings of conventional oilfield tubulars connected in an end-to-end fashion. In a particular described embodiment, a dual-walled coiled tubing running string is used to transport an ESP into a wellbore. The dual-walled coiled tubing running string arrangement could also be used to transport and power other electrically-operated devices, such as electrical sensors, electric heaters or electric motors. Electric current is transmitted along the dual-walled coiled tubing running string via skin effect. A conductive shroud arrangement is used to communicate power from the running string to the pump section of the ESP. A power cable can be eliminated as a means of transmitting power to the ESP from surface. In alternative embodiments, the dual-walled coiled tubing string of the present invention could be used as a backup power is transmission scheme for the ESP in the event of failure of the primary power cable. In described embodiments, a dual-walled coiled tubing arrangement includes an inner coiled tubing string and an outer tubing string that are formed of conductive material or which include conductive paths. Separators or isolators maintain separation of the inner and outer coiled tubing strings along their lengths. The dual-walled coiled tubing string structure can be assembled, coiled onto a spool, transported to a well location and injected into a well as a unit.

Conductors extend from each of the inner and outer coiled tubing strings to motor windings so as to energize the stator of the motor and thereby rotate the rotor. The conductors may be in the form of insulated wiring or another mechanical method of direct attachment to the motor may be used. Three-phase star-wire configurations can be used to induce rotor rotation in an alternating current ESP motor. In other embodiments, a brushless DC motor could be used to power the ESP, allowing for an efficient drive which offers low power loss.

In practice, the invention affords a number of advantages as compared to conventional power transmission methods. Waste heat from power transmission can mitigate the effects of high viscosity of fluids being transported through the inner coiled tubing string to surface. The heat generated by transmission of electric power via the coiled tubing assembly will lower the viscosity of transported fluids, thereby allowing easier flow to surface. Also, the inventors believe that the addition of a second coiled tubing string to support the ESP is advantageous and would be preferable over the current banding method used to attach the ESP to a single coiled tubing string. The inventors also believe the use of a dual-walled coiled tubing running string provides extra physical support for the ESP.

In an exemplary method of operation, an ESP is secured to a dual-walled coiled tubing running string and disposed into a wellbore. The running string is then disposed into the wellbore until the ESP is located at a desired location within the wellbore for pumping fluid. Thereafter, electric power is transmitted to the motor of the ESP from a surface-based power supply via the running string.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

The term "dual-walled," as used herein, is intended to refer broadly to arrangements wherein an inner tubular string or member is located radially within an outer tubular string or member to provide a dual-walled tubing structure. A structure can be dual-walled without regard to whether the inner and outer tubular strings are coaxial or concentric.

Figure 1:
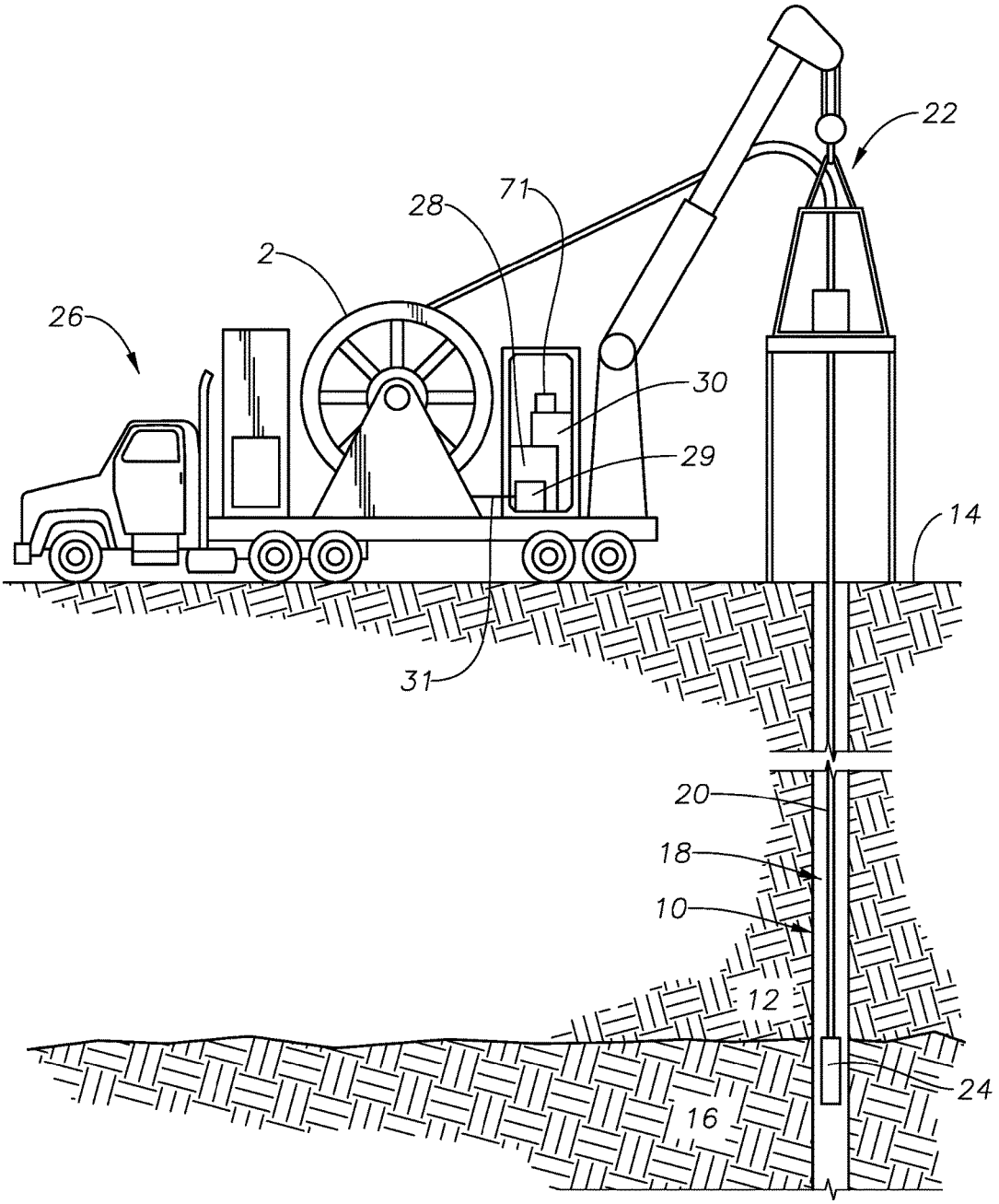
FIG. 1 is a side, cross-sectional view of an exemplary wellbore which has an ESP production assembly disposed therein having a dual-walled coiled tubing running string and which is constructed in accordance with the present invention.

FIG. 1 illustrates an exemplary wellbore 10 that has been drilled through the earth 12 from the surface 14 down to a subterranean hydrocarbon-bearing formation 16. The formation 16 may be one containing heavy oil or a shale oil formation. It is desired to pump hydrocarbon fluids from the formation 16. It is noted that, while wellbore 10 is illustrated as a substantially vertical wellbore, it might, in practice, have portions that are inclined or horizontally-oriented.

An electric submersible pump (ESP) production assembly 18 is being disposed within the wellbore 10. The assembly 18 includes a dual-walled running string 20 that is shown having been injected into the wellbore 10 from the surface 14 by a coiled tubing injection arrangement 22. Those of skill in the art will understand that while a coiled tubing-style running string is depicted, a dual-walled running string 20 might also be constructed from multiple sections of conventional oilfield tubular members which are interconnected (typically by threading) in an end-to-end fashion. An ESP 24 is secured to the distal end of the dual-walled running string 20. A typical ESP includes a pump section, seal section and motor section, as is known in the art.

The dual-walled running string 20 is shown stored on a coiled tubing reel 25 which is mounted upon truck 26. The truck 26 is also provided with an electrical power source or generator 28 and motorized equipment 30 of a type known in the art to rotate the reel 25.

Figure 2:
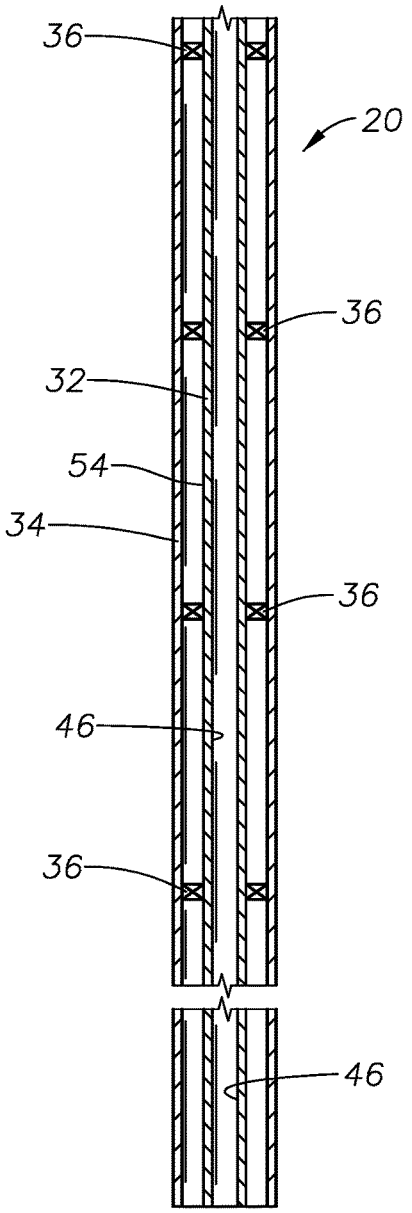
FIG. 2 is a side, cross-sectional view of a portion of the dual-walled coiled tubing running string shown in FIG. 1.

FIG. 2 depicts portions of an exemplary dual-walled running string 20 in greater detail. The depicted dual-walled running string 20 is a dual-walled coiled tubing string which includes an inner coiled tubing string 32 and an outer coiled tubing string 34. Each of these strings 32, 34 are formed of a suitable electrically conductive material, such as ferromagnetic steel or steel alloy. The inner and outer coiled tubing strings 32, 34 are separated from each other along their lengths by a plurality of isolators or separators, shown schematically at 36. In the embodiment depicted in FIG. 2, the isolators 36 are constructed so as not provide a conductive path between the inner and outer coiled tubing strings 32, 34.

Figure 3:
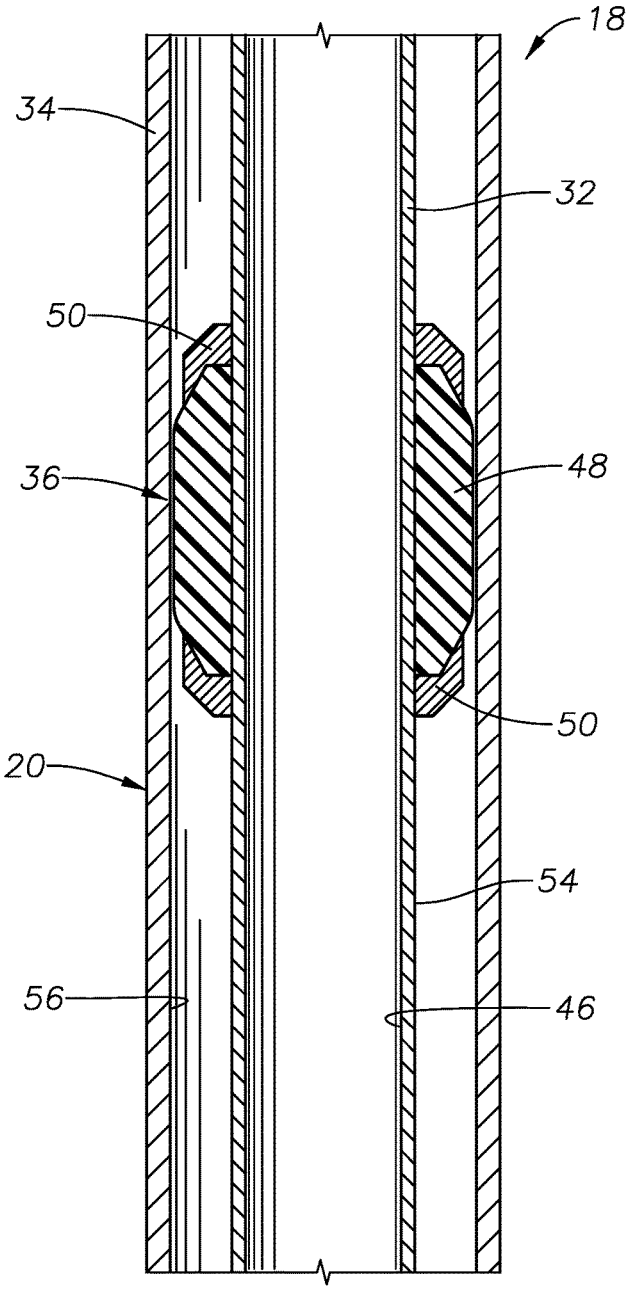
FIG. 3 is a cross-sectional detail view showing an exemplary isolator which could be used with the dual-walled coiled tubing running string shown in FIG. 2.

FIG. 3 is an enlarged cross-sectional view depicting one type of exemplary isolator 36 in greater detail. The isolator 36 includes a non-conductive separator portion 48. The separator portion 48 may be formed of, for example, ceramic, thermoplastics or elastomers. Clamp rings 50 are located on each axial side of the separator portion 48 and secure the separator portion 48 to the inner coiled tubing string 32. Alternatively, the isolator 36 could be secured with plastic wedges inserted into tapered slots so that they press against the inner coiled tubing string 32. It is preferred that the isolators 36 be affixed to the inner coiled tubing string 32 at regular spaced intervals that are sufficient to maintain complete separation of the inner and outer coiled tubing strings 32, 34 along their lengths. This separation ensures that there is no short-circuiting of the conductive pathway provided by the inner and outer coiled tubing strings 32, 34 and ring 38. In addition, arranging isolators along the tubing length assures that an air gap separates the inner and outer coiled tubing strings. Isolators may, for example, be positioned about 1 meter apart along the length of the tubing strings 32, 34 to prevent the inner tubing string 32 from sagging between isolators. An air gap of 10 mm provides a resistance to arcing of 30,000 volts. Thus, a spacing from about 1 mm to about 10 mm can provide sufficient insulation for typical voltages of from about 500 volts to about 5000 volts. Current travels on the radial exterior of the inner coiled tubing string 32 and on the inside of the outer coiled tubing string 34 to an extent depending upon the frequency. The coiled tubing string material is heated by the inefficiency of the current flowing in the surfaces of the coiled tubing strings 32, 34. The coiled tubing strings 32, 34 are connected to the electrical power generator 28 directly or via wiring.

Figure 4:
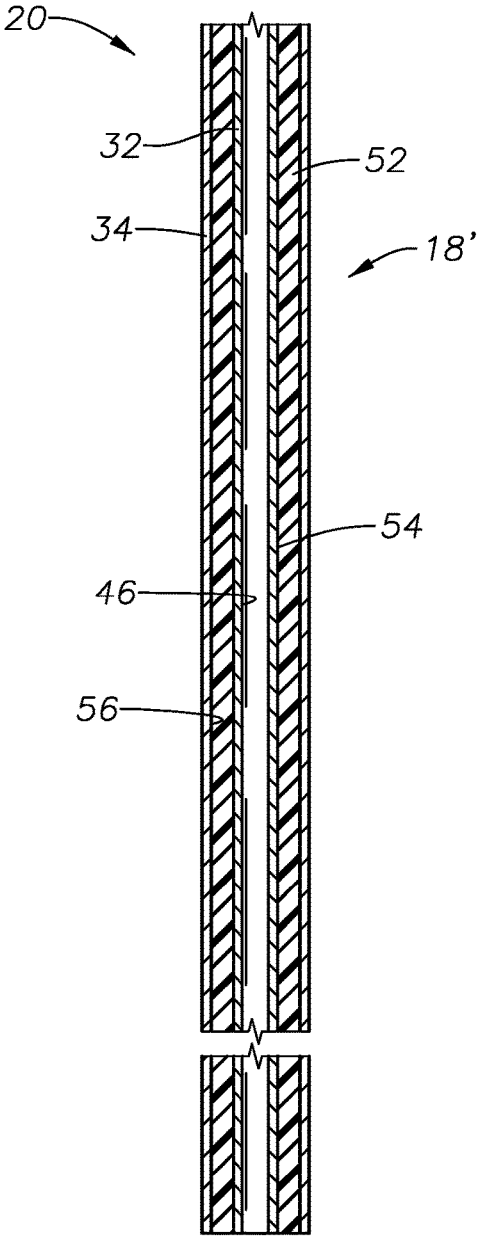
FIG. 4 is a side, cross-sectional view of a portion of an alternative construction for a dual-walled coiled tubing running string.

FIG. 4 illustrates an alternative embodiment for an ESP production assembly 18' wherein the discrete isolators 36 have been replaced with a unitary non-conductive sleeve 52. In the depicted embodiment, the sleeve 52 is formed of elastomer and, preferably, elastomeric foam. However, other electrically non-conductive materials might be used as well.

In further alternative embodiments for a dual-walled coiled tubing arrangement, the isolators 36 or sleeve 52 are replaced by a non-conductive coating that is applied to either or both of the outer radial surface 54 of inner coiled tubing string 32 and/or the inner radial surface 56 of the outer coiled tubing string 34. In other embodiments, a suitable non-conductive pressurized sand or powder such as perlite could provide an insulative layer between the inner and outer coiled tubing strings 32, 34.

Electrical power source 28 (FIG. 1) is interconnected with the inner and outer coiled tubing strings 32, 34 and causes the inner and outer coiled tubing strings 32, 34 to be heated by excitation from the power source. The power source 28 may be any means known in the art to deliver electrical power. In certain embodiments, power is supplied to the inner and outer coiled tubing strings 32, 34 in radio frequencies in the range of 500 Hz to 500,000 Hz, and may typically range from 1-20 kHz. In an alternative embodiment, where heating is to be minimized, the frequency can be 60 Hz or even lower (i.e, about 20 Hz), since the skin depth will be the full thickness of the tubing strings 32, 34 at such low frequencies. Suitable circuitry for converting three-phase power to a square wave, for example, is described in detail in U.S. Pat. No. 8,408,294 ("Radio Frequency Technology Heater for Unconventional Resources" issued to Jack E. Bridges)(the '294 patent). A particular circuit that would be useful for this application is illustrated in FIG. 11 of the '294 patent. Other electrical phase converters, including digital or rotary phase converters, are known in the art for transforming multiple phase power, such as three-phase power, into single phase electrical power. A first phase converter is depicted as 29 in FIG. 1. Single-phase electric power is then transmitted to the inner coiled tubing string 32 of the dual-walled running string 20 via wiring 31, and the ground terminal is connected to the outer coiled tubing string 34 at the wellhead. Current then flows down the inner coiled tubing string 32 to its distal end and, through a conductive pathway provided by the motor of the ESP 24, back up the outer coiled tubing string 34.

Figure 5:
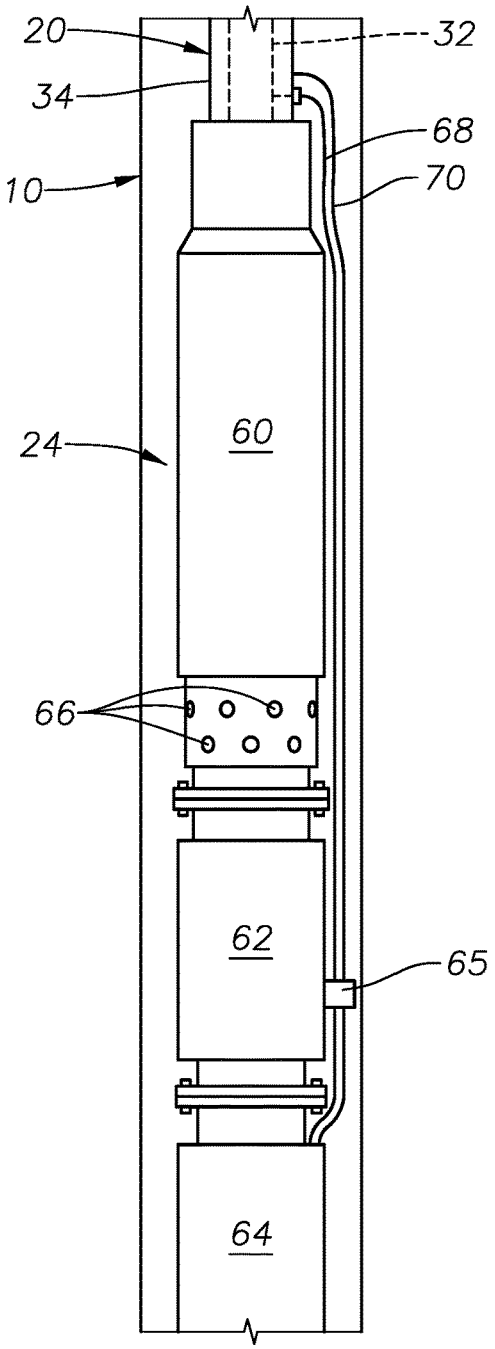
FIG. 5 depicts in greater detail an exemplary interface between the dual-walled coiled tubing string and the motor section of an electric submersible pump.

FIG. 5 depicts an exemplary power interface between the dual-walled coiled tubing string 20 and the ESP 24 in greater detail. The ESP 24 includes a pump section 60, a seal section 62 and a motor section 64. The general operation of each of these component sections is well known to those of skill in the art and, therefore, will not be described in detail here. For clarity, each of these sections 60, 62, 64 are shown schematically in FIG. 5. The pump section 60 includes fluid inlets 66 through which well fluids are drawn and pumped by the pump section 60 to the flowbore 46 of the inner coiled tubing string 32.

A first conductor 68 extends from the inner coiled tubing string 32 to the motor section 64 while a second conductor 70 extends from the outer coiled tubing string 34 to the motor section 64. The first and second conductors 68, 70 may be in the form of insulated wiring. Electrical power is transmitted by the first and second conductors 68, 70 through the electrical windings of the stator of the motor section 64. In typical embodiments, the motor section 64 comprises a motor which used alternating current, three-phase electrical power.

A second electric phase converter 65, of a type known in the art, can be used to convert the single-phase power transmitted along the dual-walled running string 20 back into three-phase power that is useful for operation of the ESP motor section 64. The second electric phase converter 65 may be a rotary or digital phase converter or other suitable phase converter device known in the art.

In alternative embodiments, single phase power is used to power a three-phase motor without need for a second electric phase converter 65. One method is to use starting capacitors for each of the three electrical phases used by the motor section 64.

The single phase power charges all three capacitors and generates the initial current needed to activate the motor's three armature assemblies 120 degrees apart. Other methods, including use of a single-phase starting motor, could be used as well.

Figure 5A:
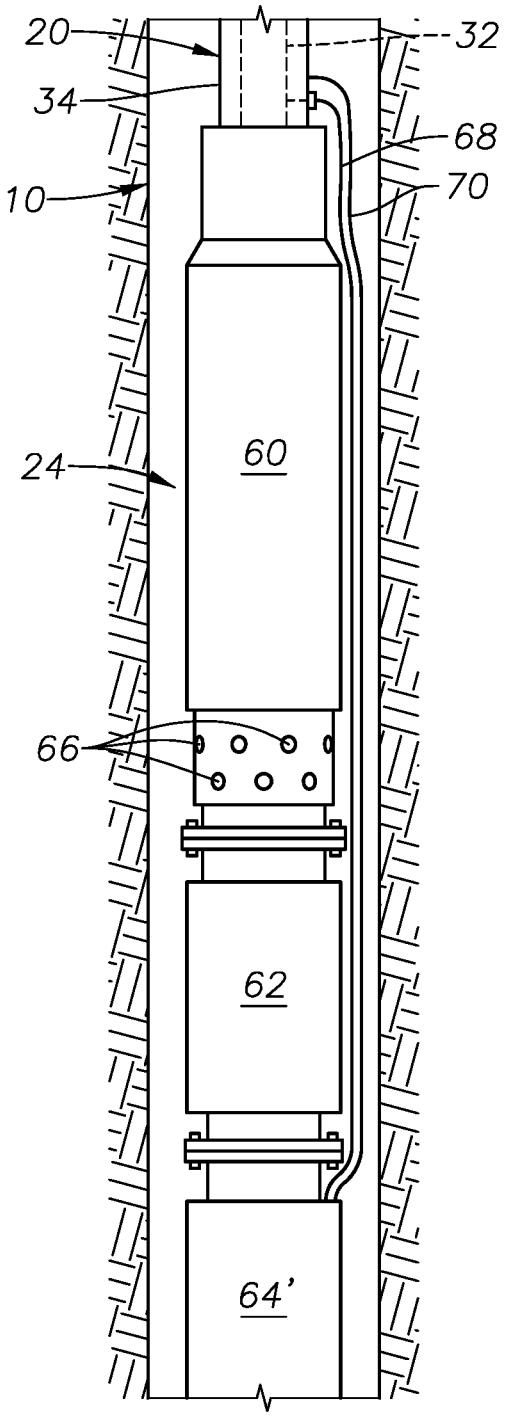
FIG. 5A depicts an alternative embodiment for an electric submersible pump production assembly which incorporates a direct current motor.

In an alternative embodiment, the motor section 64' comprises a brushless DC (direct current) motor. FIG. 5A illustrates in schematic fashion the use of a DC motor 64' which is provided power from surface 14. In this embodiment, there is no need for a second electric phase converter 65. Use of a DC motor would allow adjustment of speed and torque by varying the DC voltage supplied to the motor 64' by power source 28.

The inventors have recognized that other advantages result from a power transmission arrangement in accordance with the present invention. First, the dual-walled running string 20 in accordance with the present invention can be manufactured inexpensively compared to single walled tubing arrangements together with a power to cable and banding the power cable to the coiled tubing at the well. Second, the heat generated by current travelling though the dual-walled running string 20 could be used to heat fluid within the central flowbore 46 of the dual-walled running string 20 as it is being flowed to surface, lowering its viscosity. As a result, less ESP power would be required to pump the fluid to surface. Third, dual-walled coiled tubing string arrangements offer the potential of deploying ESPs in more challenging environments, such as sour wells, for longer periods of time, as the coiled tubing may provide greater anti-corrosion resistance than an armored power cable would provide.

Figure 6:
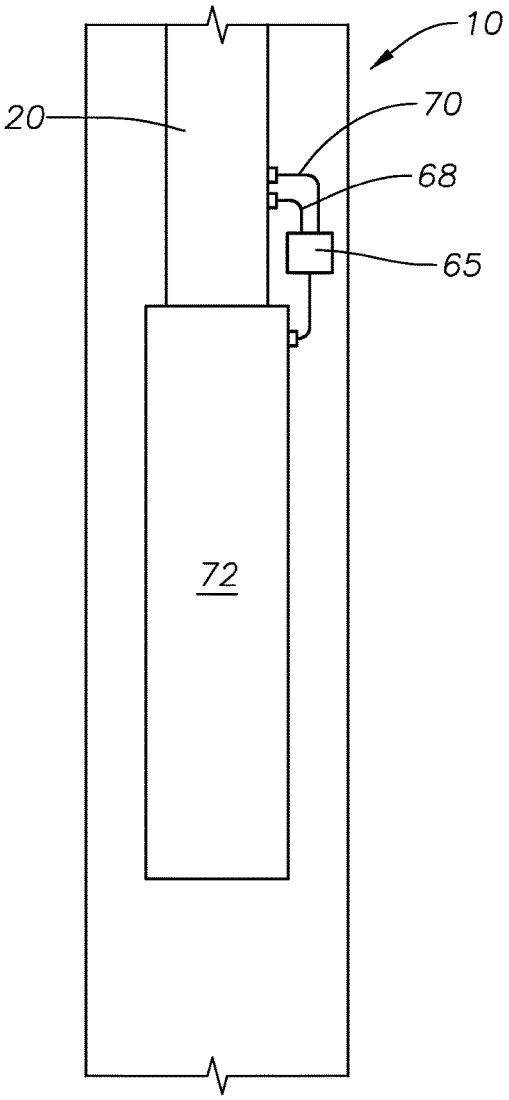
FIG. 6 is a side, cross-sectional view schematically depicting an exemplary downhole heating device which is powered by electric power transmitted via a dual-walled running string.
Figure 7:
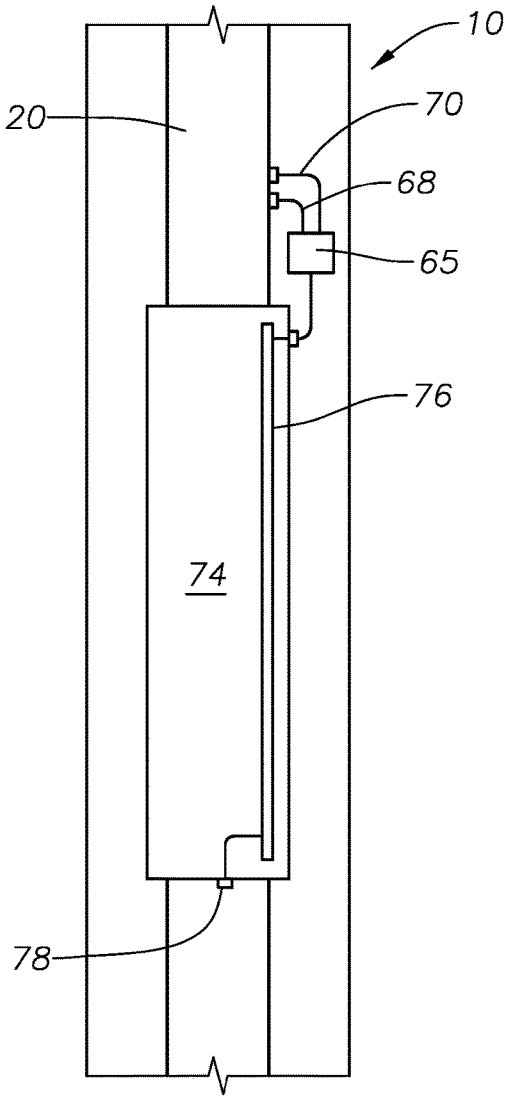
FIG. 7 is a side, cross-sectional view of an electric sensor module which is powered by electric power transmitted via a dual-walled running string.

The dual-walled running string 20, associated power supply 28 and phase converters 29, 65 could be used to power a variety of other electrically-powered downhole devices or tools, including electrical sensors, electric heaters and electric motors. FIGS. 6 and 7 illustrate instances wherein a dual-walled running string 20 and associated power supply 28 are used to power a downhole heater (FIG. 6) and downhole sensors (FIG. 7). In FIG. 6, an electrically powered downhole heater 72 is carried by dual-walled running string 20. Conductors 68, 70 extend from the dual-walled running string 20 to the downhole heater 72. An electric phase converter 65 is used to convert single phase electric power to multiple-phase electric power that is useful to power the downhole heater 72. Although not shown in FIG. 6, it should be understood that an electric power supply 28 and an electric power phase converter 29 are located at surface 14 and operably interconnected with the dual-walled running string 20 to provide single phase electrical energy to the running string 20. In FIG. 7, an electrical sensor module 74 is shown carried by a dual-walled running string 20. Conductors 68, 70 extend from the dual-walled running string 20 to the sensor module 74. An electric phase converter 65 is used to convert single phase electric power to multiple-phase electric power to power the sensor module 74. Generally, however, the exemplary sensor module 74 includes a circuit board 76 within the module 74 and at least one sensor 78 that is capable of detecting at least one downhole parameter (i.e., temperature, pressure, etc.) and transmitting a signal representative of the detected parameter to the circuit board 76. The circuit board 76 is typically capable of storage of data related to the parameter(s) detected and perhaps performing some calculations or other processing of this data.

It should be understood that the invention provides broadly an arrangement for operating a downhole electrically operated tool in a subterranean location within a wellbore 10 which includes a downhole electrically operated tool, a conductive dual-walled running string 20 and an electric power source 28 which is operably associated with the running string 20 and electrically operated tool to transmit electrical operating energy to the electrically operated tool via the dual-walled running string 20. In particular embodiments, the arrangement for operating a downhole electrically-operated tool includes at least one electric phase converter 29, 65 that is configured to convert electrical power between single phase and multiple phase electrical power, such as three-phase electric power. In an exemplary described embodiment, the downhole electrically operated tool is the motor section 64 of an electric submersible pump assembly 24.

In more particular aspects, the invention provides an electric submersible pump production assembly 18 useful for pumping fluid from a downhole location in a wellbore 10. The described electric submersible pump production assembly 18 includes an electric submersible pump 24 having an electric motor section 64 and a conductive dual-walled running string 20. The electric submersible pump production assembly 18 also includes a power source 28 that is operably connected with the dual-walled running string 20 to transmit electric power through the dual-walled running string 20. The electric motor section 64 of the electric submersible pump 24 is powered by electric power that is transmitted through the dual-walled running string 20. In particular embodiments, the electric submersible pump production assembly 18 also includes at least one electric phase converter 29, 65.

In other aspects, the invention provides a method for operating a downhole electrically operated device, such as ESP 24, at a subterranean location in a wellbore 10. In accordance with the method, the downhole electrically operated device is run into a wellbore 10 with a dual-walled running string 20 to the subterranean location. An electric power source 28 at surface 14 transmits electric power to the downhole electrically operated device via the dual-walled running string 20. In accordance with further features of the method, electric power is converted between single-phase electric power and multiple-phase electric power.

Those of skill in the art will recognize that numerous modifications and changes may be made to the exemplary designs and embodiments described herein and that the invention is limited only by the claims that follow and any equivalents thereof.

What is claimed is:

1. An arrangement for operating a downhole electrically operated tool in a subterranean location within a wellbore, the arrangement comprising:

a downhole electrically operated tool;

a conductive dual-walled running string affixed to the downhole electrically operated tool for disposing the electrically operated tool into the wellbore, the dual-walled running string being made up of an outer coiled tubing string and an inner coiled tubing string which is disposed radially within the outer coiled tubing string;

an electric power source located at surface and operably connected with the dual-walled running string to transmit electric power through the dual-walled running string;

the downhole electrically operated tool being powered by electric operating power that is transmitted through at least the inner tubing string of the dual-walled running string;

one or more electric power phase converters for converting electric power between single phase electric power and multiple-phase electric power;

a first conductor which extends from an inner coiled tubing string of the dual-walled coiled tubing running string to the electrically operated tool;

a second conductor which extends from the outer coiled tubing string to the electrically operated tool; and wherein at least one of the one more electric power phase converters is operably interconnected with both of the first and second conductors.

2. The arrangement of claim 1 wherein the dual-walled running string further comprises:

an axial flowbore defined along the length of the inner coiled tubing string; and wherein electrical operating power is transmitted along both the inner and outer coiled tubing strings.

3. The arrangement of claim 2 wherein the dual-walled running string further comprises at least one isolator disposed radially between the inner and outer coiled tubing strings to ensure separation of the inner and outer coiled tubing strings.

4. The arrangement of claim 3 wherein the isolator comprises a non-conductive coating disposed upon at least one of: an outer radial surface of the inner coiled tubing string, and an inner radial surface of the outer coiled tubing string.

5. The arrangement of claim 1 wherein the downhole electrically operated tool comprises the motor section of an electric submersible pump.

6. The arrangement of claim 5 wherein the motor section comprises a direct current motor.

7. The arrangement of claim 1 wherein the downhole electrically operated tool comprises at least one of the group consisting of an electric sensor, an electric heater and an electric motor.

8. The arrangement of claim 1 wherein the electric power source is a multiple-phase electric power supply.

9. An electric submersible pump production assembly for use in pumping fluid from a subterranean location within a wellbore, the production arrangement comprising:

a electric submersible pump assembly having an electrically powered motor section;

a dual-walled coiled tubing running string affixed to the electric submersible pump for disposing the electric submersible pump into the wellbore;

an electric power source located at surface operably connected with the dual-walled coiled tubing string to transmit electric operating power through inner and outer tubing strings of the dual-walled coiled tubing string via skin effect;

the motor section of the electric submersible pump being powered by electric power that is transmitted through the inner and/or outer tubing strings;

one or more electric power phase converters for converting electric power between single phase electric power and multiple-phase electric power;

a first conductor which extends from an inner coiled tubing string of the dual-walled coiled tubing running string to the motor section;

a second conductor which extends from the outer coiled tubing string to the motor section; and wherein at least one of the one more electric power phase converters is operably interconnected with both of the first and second conductors.

10. The electric submersible pump production assembly of claim 9 wherein the dual-walled coiled tubing running string further comprises:

an inner coiled tubing string which defines an axial flowbore along its length;

an outer coiled tubing string which radially surrounds the inner coiled tubing string; and wherein the inner and outer coiled tubing strings are each formed of electrically conductive material.

11. The electric submersible pump production assembly of claim 10 wherein the dual-walled coiled tubing string further comprises at least one isolator disposed radially between the inner and outer coiled tubing strings to ensure separation of the inner and outer coiled tubing strings.

12. The electric submersible pump production assembly of claim 11 wherein the isolator comprises a plurality of discrete spacer rings formed of non-conductive material.

13. The electric submersible pump production assembly of claim 11 wherein the isolator comprises a spacer sleeve formed of non-conductive material.

14. The electric submersible pump production assembly of claim 11 wherein the isolator comprises a non-conductive coating disposed upon at least one of: an outer radial surface of the inner coiled tubing string, and an inner radial surface of the outer coiled tubing string.

15. The electric submersible pump production assembly of claim 9 wherein the motor section comprises a direct current motor.

16. A method for operating a downhole electrically operated device at a subterranean location within a wellbore, the wellbore extending downwardly from a surface of the earth, the method comprising the steps of:

running the downhole electrically operated device into a wellbore with a dual-walled running string to the subterranean location;

transmitting electric operating power from an electric power source at the surface to the downhole electrically operated device through the dual-walled running string;

the downhole electrically operated device being powered by electric power that is transmitted through inner and outer tubing strings of the dual-walled running string via skin effect;

converting electric power transmitted from the electric power source to the dual-walled running string between multiple phase to single phase electric power with an electric power phase converter;

wherein electric power is transmitted between the inner coiled tubing string and the electric power phase converter via a first conductor; and electric power is transmitted between the outer coiled tubing string and the electric power phase converter via a second conductor.

17. The method of claim 16 further comprising the steps of:

converting electric power transmitted from the electric power source to the dual-walled running string from multiple phase to single phase electric power; and converting electric power transmitted from the dual-walled running string to the downhole electrically operated device from single phase to multiple phase electric power.

* * * * *